US006030140A

United States Patent [19]

Karten et al.

[11] Patent Number: 6,030,140

[45] Date of Patent: Feb. 29, 2000

[54] BINDER

[75] Inventors: Stuart Karten, Venice; Paul Kirley, Los Angeles; Dennis Schroeder, Hermosa Beach, all of Calif.

[73] Assignee: Avery Dennison Corporation, Pasadena, Calif.

[21] Appl. No.: 09/167,348

[22] Filed: Oct. 7, 1998

[51] Int. Cl.[7] ..... B42F 13/00; B42D 1/00

[52] U.S. Cl. ..... 402/73; 402/77; 402/62; 402/21; 402/24; 281/15.1; 281/49; 281/33; 281/18; 281/32; 281/206; 281/387; 281/232; 281/29

[58] Field of Search ..... 206/425; 281/21.1, 281/22, 28, 29, 31, 37, 45, 44; 402/70, 73, 80 R, 22; 220/256, 259, 315

[56] References Cited

U.S. PATENT DOCUMENTS

| | | | |
|---|---|---|---|
| 442,231 | 12/1890 | Lieker | 150/118 |
| 781,948 | 2/1905 | Hegele | 281/19.1 |
| 1,009,071 | 11/1911 | Jensen | 281/15.1 |
| 1,204,387 | 11/1916 | Akans | 402/62 |
| 1,887,530 | 11/1932 | Trussell | 402/77 |
| 2,078,098 | 4/1937 | Parkin | 220/55 |
| 2,155,203 | 4/1939 | Polacsek | 206/29 |
| 2,687,157 | 8/1954 | Cowan | 220/4.23 |
| 3,343,709 | 9/1967 | Hendreson | 220/41 |
| 3,771,890 | 11/1973 | Notto | 402/21 |
| 3,936,202 | 2/1976 | Brajituli | 402/24 |
| 4,058,327 | 11/1977 | Sullivan et al. | 281/33 |
| 4,306,737 | 12/1981 | Errichiello | 281/32 |
| 4,588,321 | 5/1986 | Egly | 402/77 |
| 4,718,550 | 1/1988 | Johnson | 206/387 |
| 4,749,098 | 6/1988 | Verdi | 220/22.5 |
| 4,932,679 | 6/1990 | Mayer et al. | 281/18 |
| 5,028,075 | 7/1991 | Donnelly | 281/49 |
| 5,209,593 | 5/1993 | Ros | 402/77 |
| 5,394,981 | 3/1995 | Cameron | 206/232 |
| 5,749,464 | 5/1998 | Cheris et al. | 206/308.1 |
| 5,752,589 | 5/1998 | Berg | 190/109 |

*Primary Examiner*—Willmon Fridie, Jr.
*Assistant Examiner*—Alisa Thurston
*Attorney, Agent, or Firm*—Oppenheimer Wolff & Donnelly LLP

[57] ABSTRACT

An improved binder formed of two cover portions made of rigid material joined together with a living hinge. A closure flap with a second living hinge joins the free ends of the cover opposite the binder spine. An improved method of attaching a pocket to the binder is also disclosed. The use of such a technique on rigid polypropylene material allows roll feeding of materials, eliminates the need for a chipboard, allows existing printing and sealing machinery to be employed in the manufacture of the binder, and provides improved durability and aesthetics at a low cost.

11 Claims, 7 Drawing Sheets

BINDER

BACKGROUND OF THE INVENTION

1. Field of Invention

The present invention relates generally to multi-ring binders for the educational market.

2. Description of Related Art

Three-ring binders made of a flexible outer jacket having a spine with a metal three ring clip are known in the art. The edges of such multi-ring binders are sometimes held together with Velcro or other such hook-and-loop fasteners Many schools have banned such hook-and-loop fastener binders because school children make excessive noise opening and closing these binders.

In addition, when mass-producing binders unit costs must be kept as low as possible, while maintaining a high quality look and feel to the binder. One area of cost involves the need to cut and size plastic stock used to make binders on conventional RF welding binder machinery.

Further, it has been found that users prefer the texture, thermal conductivity, resiliency and look and feel of certain materials. Consumers are willing to pay a premium for products that are aesthetically pleasing to the touch. Further, consumers are also willing to pay a premium for products that are more durable, and have a sleek look to them, such as for products made from injection moulded polypropylene.

SUMMARY OF THE INVENTION

Accordingly, the object of the present invention is to provide an improved three-ring binder that solves the above mentioned problems using both improved materials and improved mechanical design.

The present invention discloses a plastic binder that is made from plastic material, preferably injection moulded polypropylene, in a novel configuration, that is both easier to manufacture in a single pass operation using existing machinery, which holds down unit costs, as well as being aesthetically pleasing.

The present design of an embodiment of the present invention, involving a pocket and living hinge latch and fastener, has numerous advantages, including but not limited to:

- a non-Velcro type fastener, which makes less noise when opening;
- a living hinge fastener or binder closure that is manufactured on the first pass of a production process;
- the incorporation of a pocket manufactured on a roll process, rather than cut from one or more sheets, to incorporate the pocket into the binder on the first pass of a production process;
- the use of a perforated mechanism for attachment of a pocket allows a press operator to easily attach the pocket by snapping it to the binder cover during the press operator's down time, avoiding the need for an additional assembly line process;
- a contemporary, aesthetically pleasing design is made without excessive weld lines, bumps or creases;
- the use of a strong, rigid material, such as injection moulded polypropylene, combines an impression of durability and aesthetics;
- the use of a rigid polypropylene shell as one of the binder covers in a unitary, one-piece manner eliminates the need for an underlying inner chipboard for strength;
- the use of dual soft and hard textures on the cover, which aid to aesthetics and have utilitarian functions.

The sum total of all of the above advantageous, as well as the numerous other advantages disclosed and inherent from the invention described herein increases consumer satisfaction and helps expand the market for binders throughout, especially from the kindergarten to high school level.

The above described and many other features and attendant advantages of the present invention will become apparent from a consideration of the following detailed description when considered in conjunction with the accompanying drawings.

BRIEF DESCRIPTION OF THE DRAWINGS

Detailed description of preferred embodiments of the invention will be made with reference to the accompanying drawings.

DETAILED DESCRIPTION OF THE PREFERRED EMBODIMENTS

Disclosed herein is a detailed description of the best presently known mode of carrying out the invention. This description is not to be taken in a limiting sense, but is made merely for the purpose of illustrating the general principles of the invention. The section titles and overall organization of the present detailed description are for the purpose of convenience only and are not intended to limit the present invention.

Figure 1:
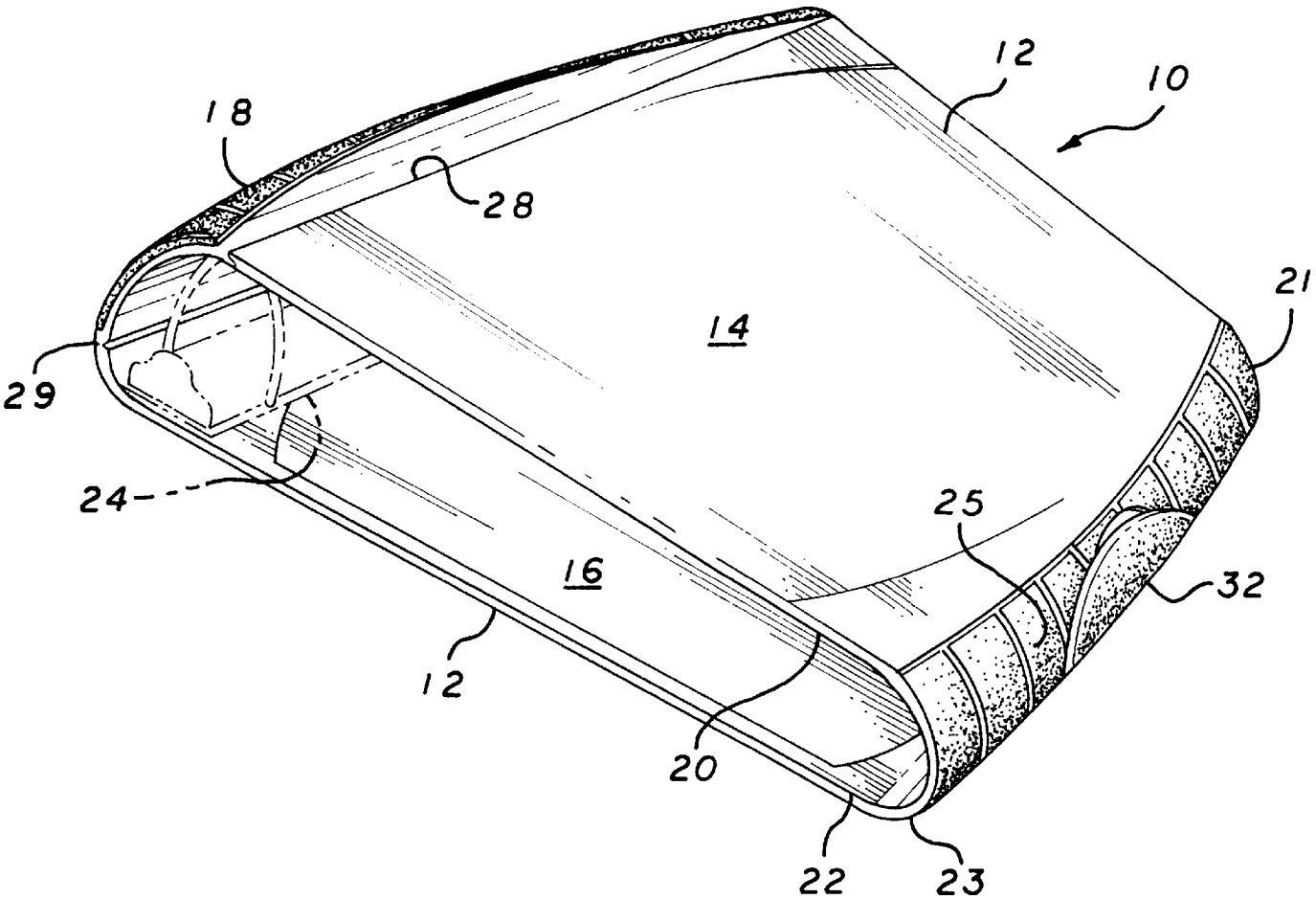
FIG. 1 is a perspective plan view of the present invention, a binder.
Figure 8:
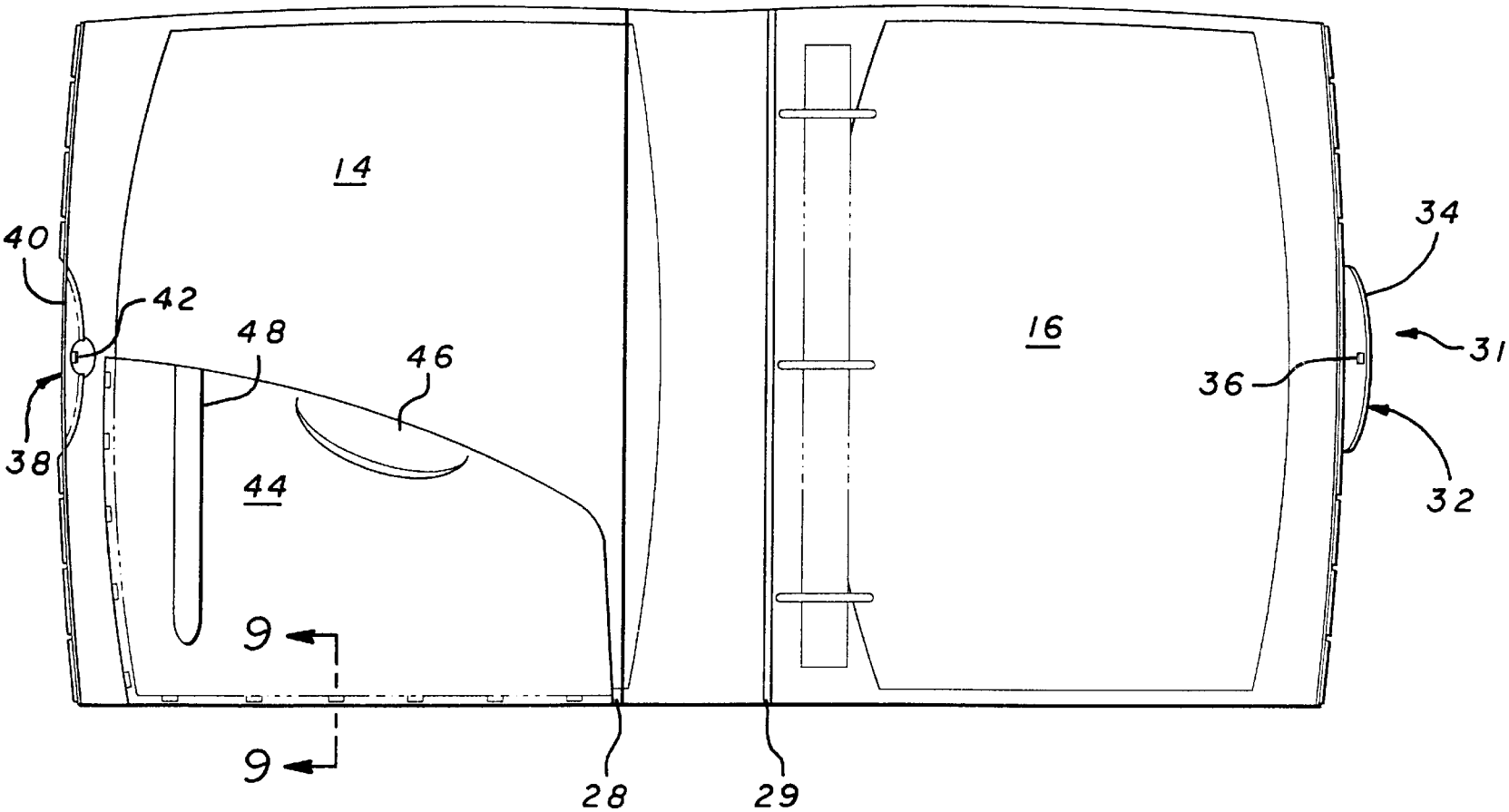
FIG. 8 is a front view of the binder of FIG. 1 opened.

FIGS. 1–11 disclose the binder of the present invention. The binder 10 has a cover 12, with front or top portion 14, which has an outside side (as shown in FIG. 1) and an inside side (as shown in FIG. 8), and a similar back or bottom portion 16, with similar outside and inside sides. The cover has a spine 18 in between the two covers, and free open end edges 20, 22, which may be curved into mating end portions 21, 23. A three-ring metal latch or clip 24, for holding paper, is attached to the back cover 16 to allow the rings to face upwards, as shown, or, alternatively, to the spine. One such metal latch is described in U.S. Pat. No. 5,354,142, incorporated herein. Other designs, such as a clasp or clamp, can be used to hold paper.

Crease lines 28, 29 form a living hinge between the front and back covers and the spine of the binder. The living hinge lines 28, 29 may be formed of the same material as the cover, e.g., in a preferred embodiment injection moulded polypropylene material, or, may be formed of a different material fastened to the material forming the cover, such as plastic tape.

At the shaded portions shown in FIG. 1, such as shown by dotted shading 25, a soft, thin layer of vinyl, rubber or thermoplastic material (such as TPR) may be adhesively secured to the underlying polypropylene, to provide a non-skid surface and for aesthetic reasons. Similarly, for aesthetic reasons and to convey information the polypropylene may be imprinted with printed matter or colors. When employing polypropylene as a material, the inks used may be of the same kind used by machinery for imprinting vinyl.

The binder has open edges 20, 22 held closed by a closure fastener flap mechanism 31. The open ends 20, 22 have flap portions 21, 23, which may be rigid extensions of the covers 14, 16 respectively (i.e., the flaps may be the covers 14, 16 curved at the open ends to meet together) engaged by the closure flap mechanism 32 to better seal the contends of the binder and prevent documents from falling out.

Regarding the closure fastener or binder closure, a lower clasp or semicircular lower flap 32, which may be formed of the same material as the cover, has a single latch protrusion 36 which extends from the lower flap 32 at right angles. The flap 32 is attached to the lower cover 16 through a living hinge. The living hinge may be formed from the same material constituting the lower cover 16 and lower flap 32, or, may be formed of a different, more flexible material to join together the more rigid lower cover and flap materials, which in a preferred embodiment are made of injection moulded polypropylene material.

Figure 2:
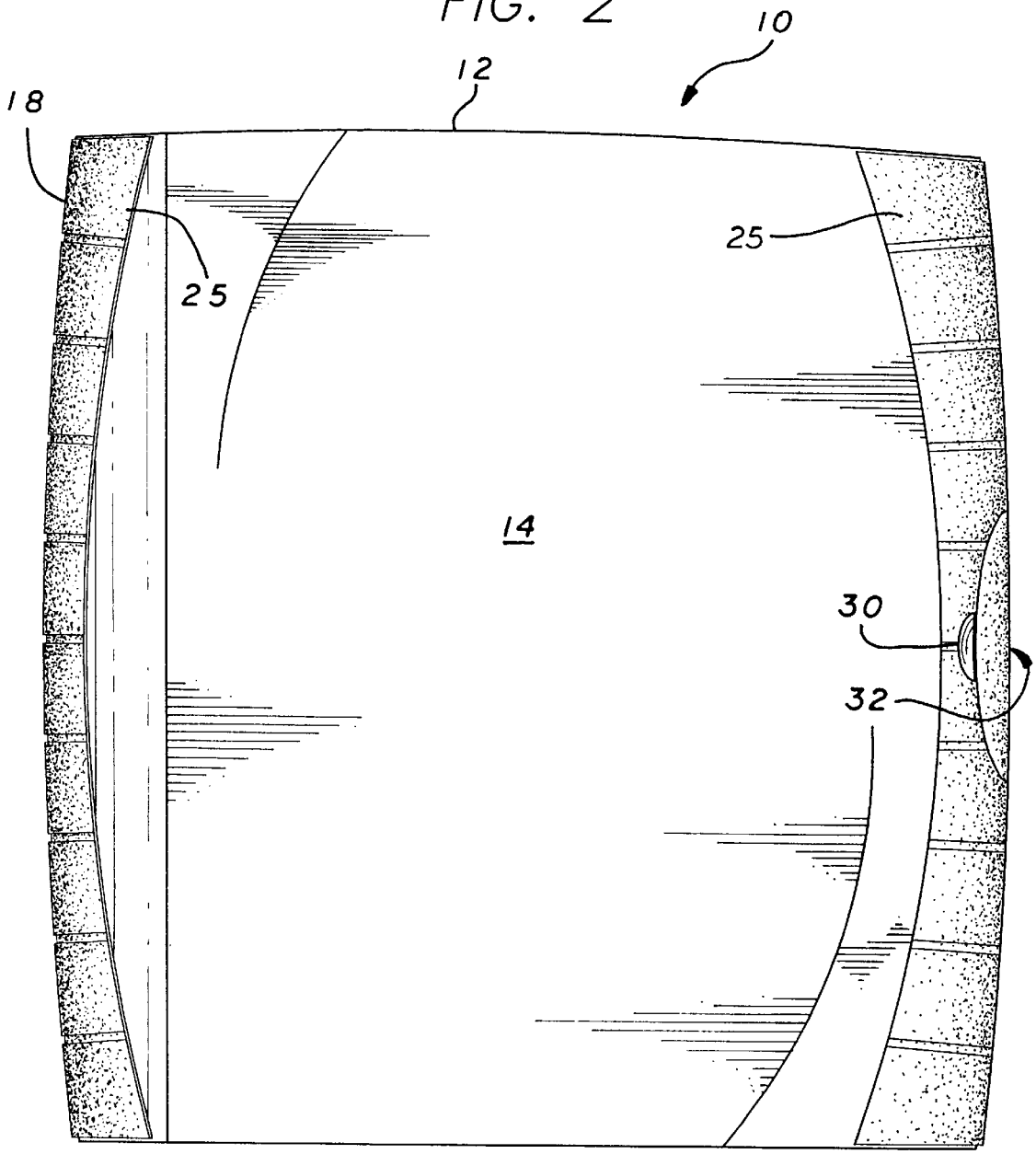
FIG. 2 is top view of the binder shown in FIG. 1.
Figure 3:
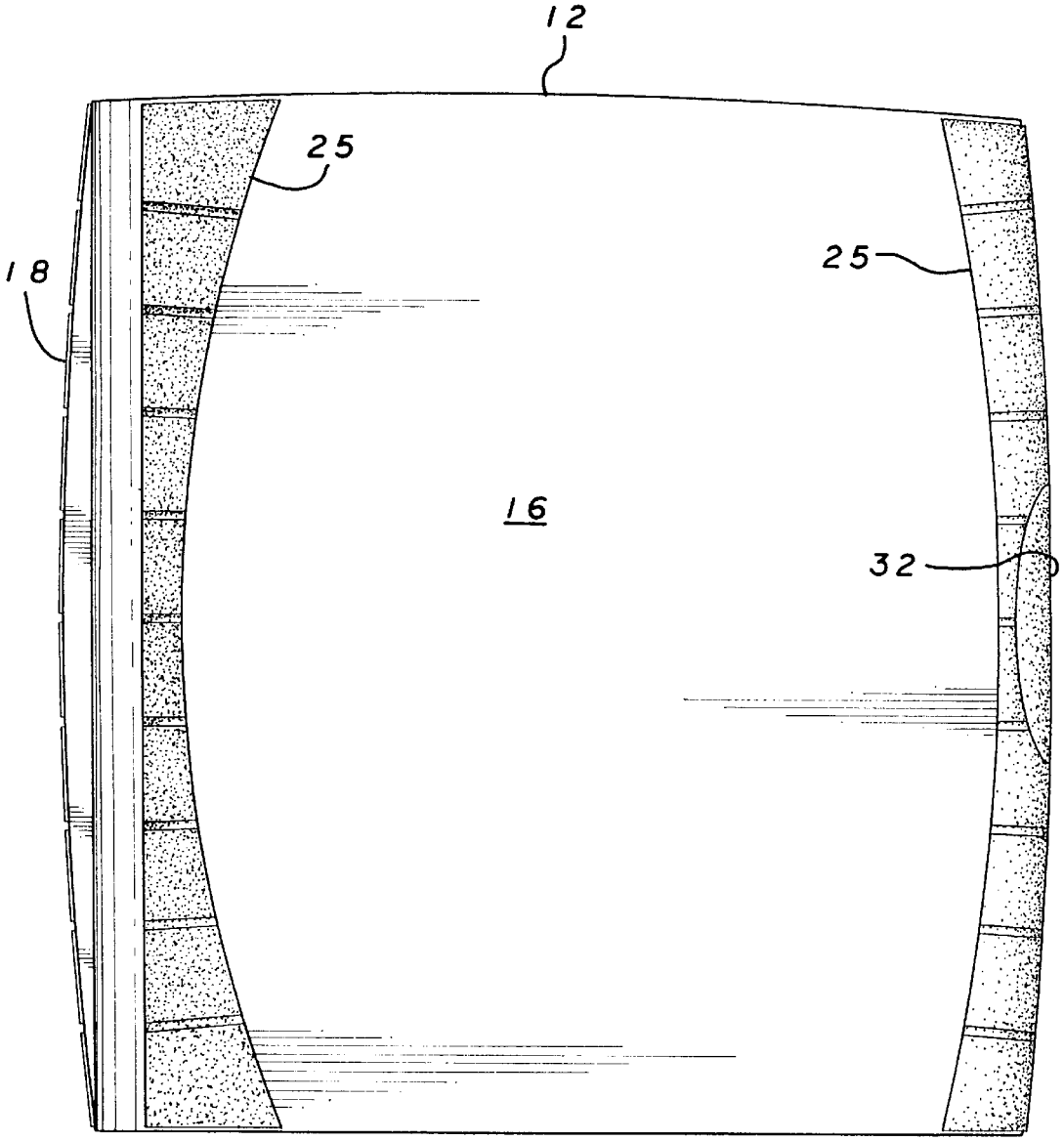
FIG. 3 is a bottom view of the binder shown in FIG. 1.
Figure 4:
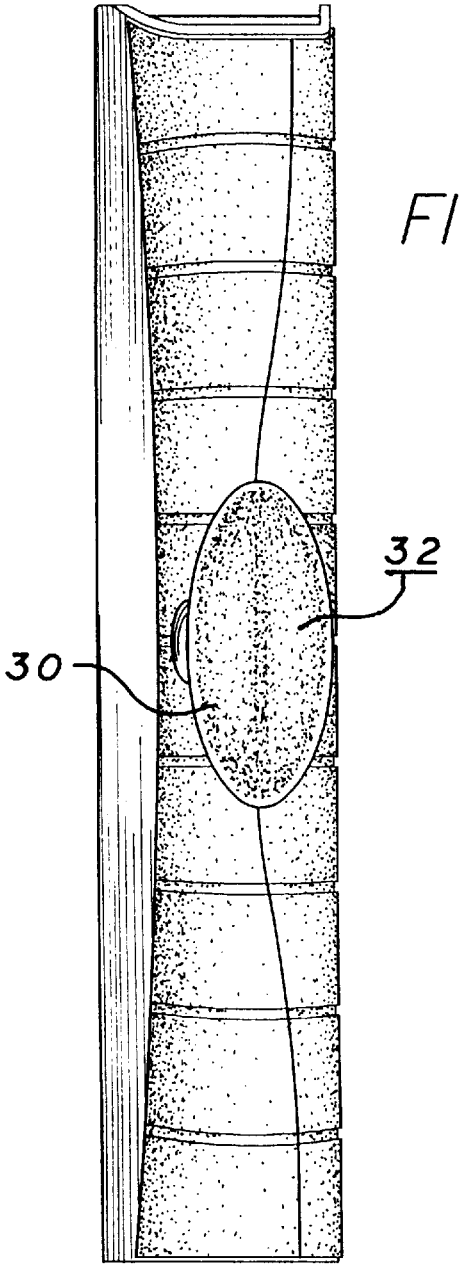
FIG. 4 is a right side view of the binder shown in FIG. 1.
Figure 5:
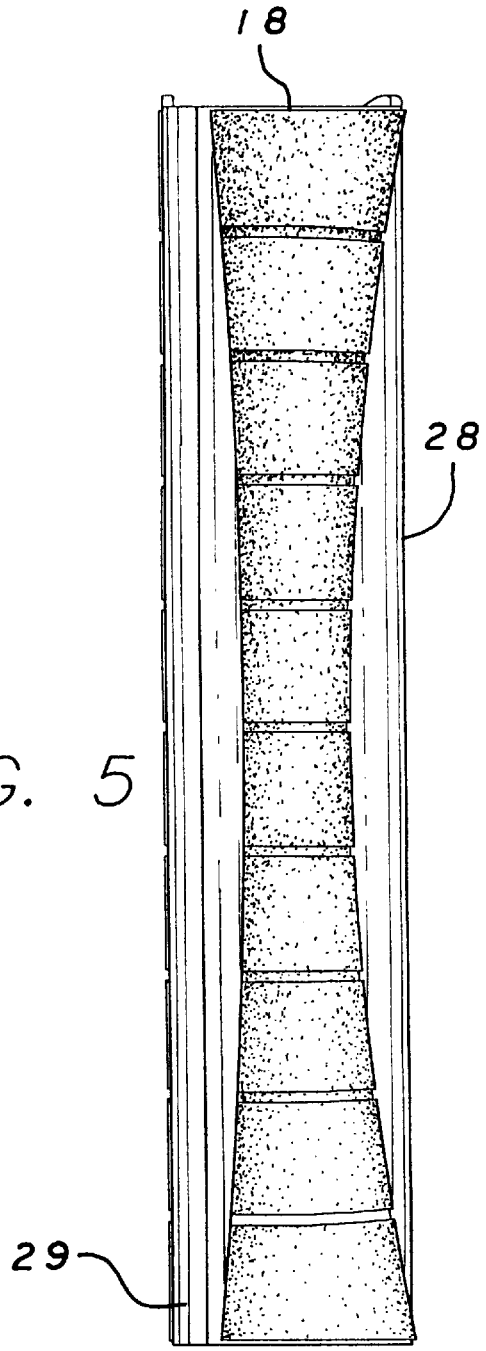
FIG. 5 is a left side view of the binder shown in FIG. 1.
Figure 6:
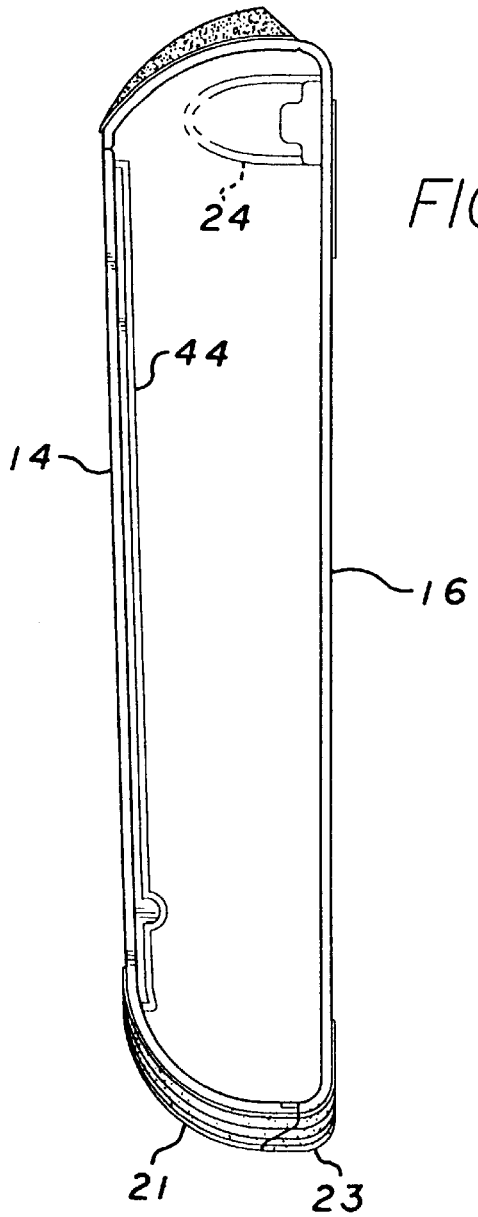
FIG. 6 is a top end view of the binder shown in FIG. 1.
Figure 7:
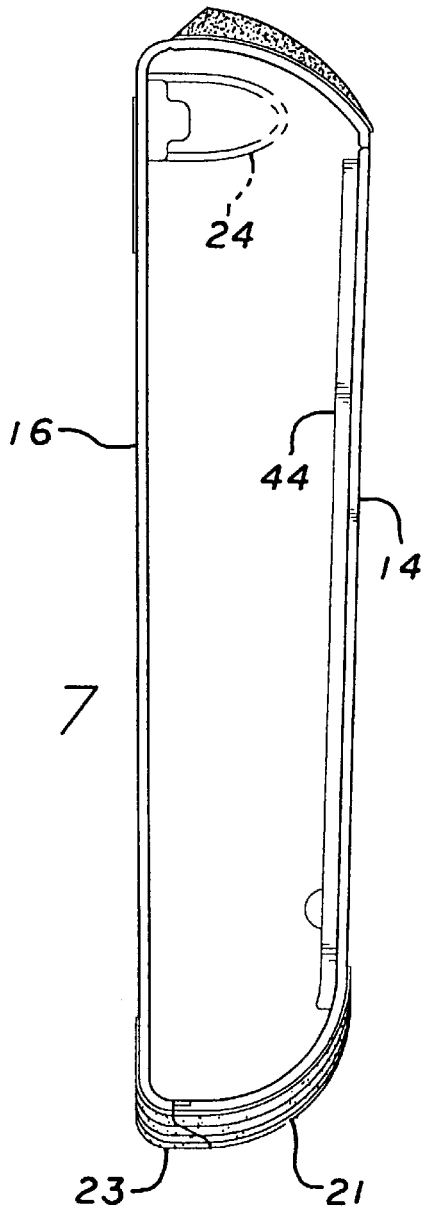
FIG. 7 is a bottom end view of the binder shown in FIG. 1.

Protrusion 36 is received by a latch aperture or depression 42 found in the mating semicircular recessed depression 40. The depression 40 contains a thumb well 30 for allowing a user to engage the tip of one's finger in the thumb well 30 and disengage the binder closure lower flap 32. The semicircular recessed depression 40 is molded into the upper portion of the binder closure, forming the mating upper fastener portion 38, and receives the lower latch 32. Upper fastener 38 is part of the upper cover portion 14 in the upper flap 21. When protrusion 36 is received within aperture 42, the binder is snapped shut along the open edges 20, 22. The closure flap 32 forms an aesthetic oval shape when viewed from the top and end, as shown in FIGS. 2 and 4. A thumb recess 30 about the aperture 42 allows easy opening of the flap with one's fingernail. The lower flap 32 allows the open ends of the binder to close and gives an aesthetically pleasing look to the binder, as well as protecting the binder more completely.

Figure 11:
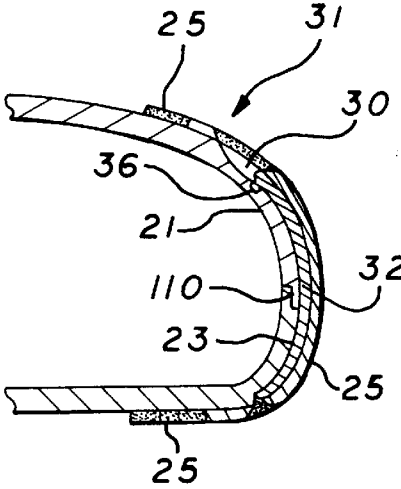
FIG. 11 is a cross sectional view along the binder closure mechanism.

Turning attention to FIG. 11, there is shown the end flaps 21, 23, which meet at a ledge 110, forming a stepped recess. The latch mechanism 31 is shown in the closed position, with lower flap 32 received by the upper fastener portion, and rubber or vinyl surface layer 25 (which has shading as indicated because some of the surface layer 25 is in relief) forming a non-skid and aesthetic surface.

The binder 10 is preferably formed of injection moulded polypropylene material, a substantially rigid or semirigid material. An optional pocket inlay may be attached to the upper cover through a hook and aperture arrangement as described herein, such as shown by section lines 9—9 in FIG. 9. Pocket 44 has raised finger hold 46 and a pen hold recess 48 molded in it.

Figure 9:
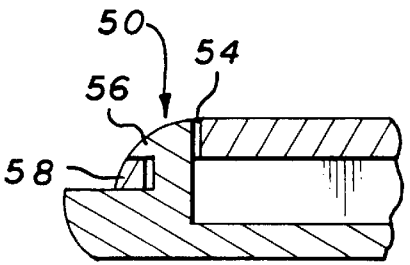
FIG. 9 is a view along the section lines 9—9 in FIG. 8.
Figure 10:
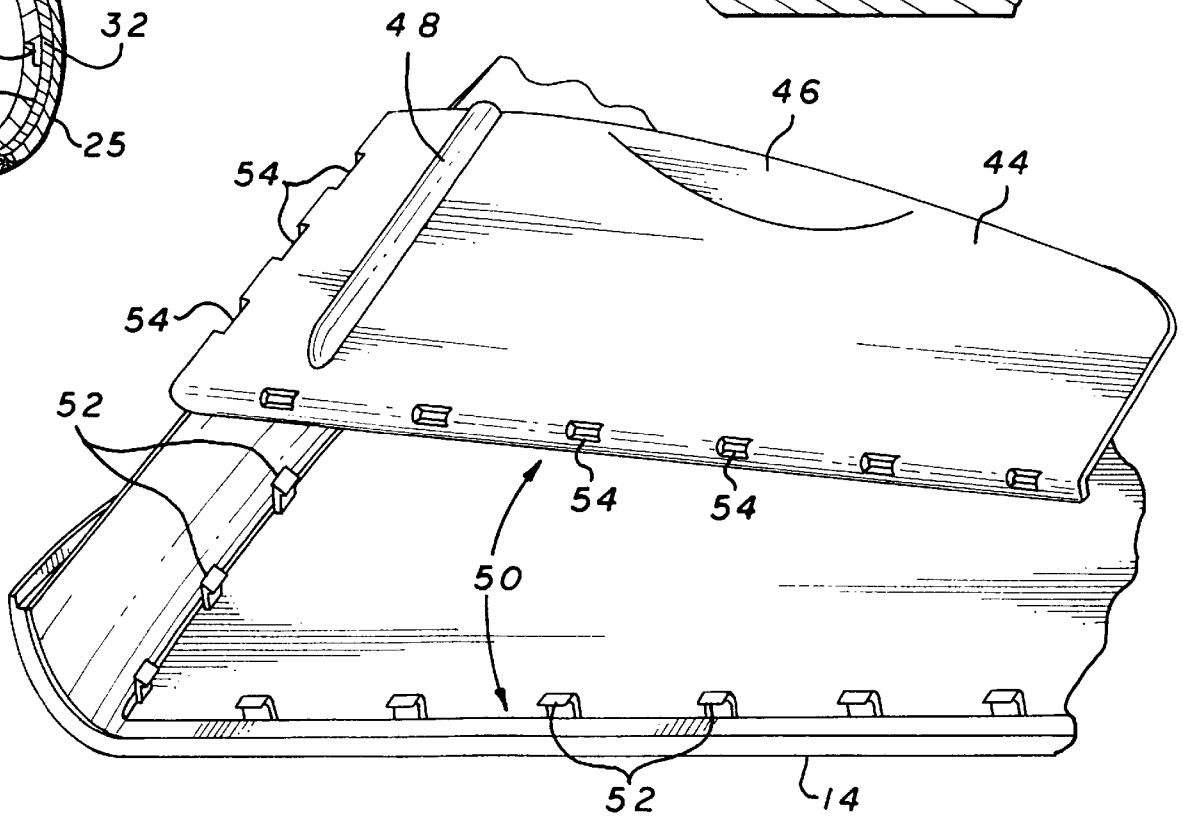
FIG. 10 is a broken view of a pocket inlay for the binder.

In FIGS. 9–10 show how the binder pocket 44 is attached to the upper half portion 14 of the cover 10 during manufacture, by a tooth and aperture arrangement 50, to help form a mechanical interlock. Both pocket 44 and the cover 10 are made of substantially hard material, injection moulded polypropylene , which also forms the bottom cover 16. A plurality of hooks or teeth 52 in the cover 14 mate with apertures or recesses 54 in the pocket 44. The hooks are formed with outward hook portions 56 that have a flat surface engaging the flat portion 58 of the pocket 44.

Turning attention now to FIG. 9, there is shown a cross-section 9—9 of a portion of the upper cover 14 of binder 10, which incorporates the hook and aperture seam 50 for holding the pocket 44 to the upper cover 14. The pocket may be on either the outside of the upper cover (not shown) or, as illustrated, on the inside of the upper cover. The inside pocket 44 is generally formed of the same material as the cover, preferably injection moulded polypropylene, but optionally may be made of a different material. Furthermore, the pocket 44 may be attached to the binder cover by a press operator during the press operator's down time, in an easy snap fit manner, by taking advantage of the mechanical interlock between the pocket inlay and the cover.

Other pocket designs are contemplated by the present invention, such as, in lieu of a pocket inlay sheet 44 that mechanically interlocks with the cover portion, having a pocket flap that is formed from the same stock roll forming the cover, and attached at the bottom side of the cover (e.g., where section line 9—9 is shown in FIG. 8) by a living hinge, so that the pocket folds about this living hinge attached at the bottom side of the cover. The pocket flap would be prevented from flapping about by being attached at the top of the pocket to the cover (e.g., at the top where finger hold 46 is) by mating studs and holes. This design eliminates the requirement of a separate pocket inlay, at the cost of having to provide a wider stock of material for the cover during assembly (as the pocket inlay would be attached, at its living hinge portion, to the bottom side of the cover at section line 9—9).

The stock forming the binder 10 itself can be cut to size during manufacture using the RF sealing die. The binder, like the pocket, can also be cut to size and shape by the RF sealing die, as both materials are roll fed together in contiguous layers, avoiding the prior techniques of heat sealing of sheets that are fed together by sheet feeding.

Thus, the method of manufacture for the two material binders of the present invention comprises feeding into an RF sealing die a first continuous stock or roll of PVC material, such as injection moulded polypropylene. The injection moulded polypropylene may come in injection molded form. The injection moulded polypropylene forms the cover 10 comprising two cover portions of the binder, covers 14, 16, and spine 18. Suitable living hinges, such as at fold lines 28, 29, connect the covers and spine. The living hinge may simply comprise crease or score lines 28, 29 of the same material as the covers 14, 16 and spine (which may be formed of a continuous sheet of material), or, the living hinge may be made of a separate, more flexible material, such as a polypropylene living hinge, which tapes together the three portions of cover 14, cover 16 and spine 10. A second roll of injection moulded polypropylene is then used to form the pocket, such as pocket 44 in FIG. 8. As described above, the edges where the two materials forming the cover 14 and pocket 44 meet are joined with mating structures, such as teeth 52 in FIGS. 9–10 mating with apertures 54. The use of such a perforated mechanism for attachment of a pocket allows a press operator to easily attach the pocket by snapping it to the binder cover during the press operator's down time, avoiding the need for an additional assembly line process. The two materials, once aligned so that hook and aperture mate, they can, if desired, be radio frequency (RF) welded, heat sealed, ultrasonically welded, mechanically fastened, interlocked or otherwise further secured together. The cover can be printed on, and PVC is easily imprinted on with existing vinyl binder industry inks and machinery. For final assembly, the metal latch is attached to the cover with nuts and bolts or rivets, or other known technologies.

Although the present invention has been described in terms of the preferred embodiments above, numerous modifications and/or additions to the above-described preferred embodiments would be readily apparent to one skilled in the art. Thus, by way of example but not of limitation, the mechanical interlock for holding the pocket in place could be an enlarged stud or mushroom shaped stem mating with a slightly smaller opening in the pocket. It is intended that the scope of the present invention extends to all such modifications and/or additions and that the scope of the present invention is limited solely by the claims set forth below.

We claim:

1. A binder comprising:

a cover comprised of two portions, a top cover portion and a bottom cover portion, said cover top and bottom portions each having an inside side and an outside side;

a pocket attached to at least one of said top and bottom portions of said cover on said inside side of said portions;

said cover and said pocket formed of substantially rigid material;

said cover having a curved spine in between said top portion and said bottom portions, and free edges opposite said spine;

said free edges having a distinct curvature and overlapping and interlocking edges so as to readily align and abut one another;

a pivoting closure fastener for said cover which is semicircular in shape, said closure fastener being attached to one of the two abutting free edges of said cover, and overlying the other free edge of said cover, fitting into a semicircular depression on the other cover and latching;

said closure fastener being automatically aligned for closure when the covers are aligned, and said closure fastener latching together said first and second cover portions and securing them together mechanically.

2. A binder as defined in to claim 1, further comprising:

a hinge in between said first and second portions of said cover, said hinge being a living hinge;

said abutting free ends received in a mating configuration; and, said closure fastener comprises the same material forming said first cover portion, and said closure fastener is attached to said cover by a second living hinge, and joining said free ends mechanically.

3. A binder as defined in claim 1, wherein:

said pocket is attached to said cover portion by mechanical interlock.

4. A binder as defined in claim 3, wherein:

said mechanical interlock is a tooth and aperture arrangement;

said mating configuration of said abutting free ends is a stepped recess.

5. The binder of claim 1, wherein:

said cover is imprinted with ink;

further comprising a second material, softer than said rigid material, secured to said rigid material on portions of said cover.

6. The binder of claim 5, wherein:

said second material is selected from the group consisting of vinyl, rubber, thermoplastic or TPE.

7. A binder comprising:

a cover comprised of two portions, a top cover portion and a bottom cover portion, said cover top and bottom portions each having an inside side and an outside side;

a pocket attached to at least one of said top and bottom portions of said cover on said inside side of said portions;

a ring binder mechanism for holding paper mounted inside said binder;

said free edges of the cover curving toward each other so as to directly engage and interlock with one-another;

said spine being curved so as to accommodate the curvature of the ring binder mechanism;

a closure fastener for said cover, said closure fastener attached to secure the free edges of said cover against separation; and said closure fastener comprising a latch formed on one of said top and bottom portion free edges, and a mating aperture formed on the other of said top and bottom portion free edges, said latch received by said aperture.

8. The binder according to claim 7, wherein:

said closure fastener further comprises a thumb recess on said free edge having said mating aperture.

9. The binder according to claim 7, wherein said latch is formed of the same material as said cover, and said latch is attached to said cover by a living hinge.

10. The binder according to claim 7, wherein:

said cover is made of rigid material comprising injection moulded polypropylene.

11. A binder comprising a cover comprised of two portions, a top cover portion and a bottom cover portion;

said covers being pivotally connected to a spine, and having outwardly extending integral free edges;

said integral free edges being directly overlapping and directly mating with one another preventing relative movement of each of the edges toward or away from the spine of the binder;

said edges extending toward one another, and each of said edges having portions thereof that overlap the other edge, both in the direction toward said spine and in the direction away from said spine; and a pivoting closure fastener attached to one of said two edges and pivoting to interlock with said other edge.

* * * * *